US011393603B2

(12) United States Patent
Carver et al.

(10) Patent No.: US 11,393,603 B2
(45) Date of Patent: Jul. 19, 2022

(54) THERMAL DIVIDER INSERT AND METHOD FOR SPENT NUCLEAR FUEL CASK CREATING BOTH AIR INLETS AND AIR OUTLETS AT THE TOP OF THE OVERPACK

(71) Applicant: NAC International Inc., Norcross, GA (US)

(72) Inventors: George C. Carver, Norcross, GA (US); Steve E. Sisley, Peachtree Corners, GA (US); Jay G. Wellwood, Peachtree Corners, GA (US); Kevin Klein, Woodstock, GA (US)

(73) Assignee: NAC INTERNATIONAL INC., Norcross, GA (US)

( * ) Notice: Subject to any disclaimer, the term of this patent is extended or adjusted under 35 U.S.C. 154(b) by 170 days.

(21) Appl. No.: 16/826,533

(22) Filed: Mar. 23, 2020

(65) Prior Publication Data

US 2021/0296018 A1 Sep. 23, 2021

(51) Int. Cl.

| | |
|---|---|
| ***G21F 5/10*** | (2006.01) |
| ***G21F 5/008*** | (2006.01) |
| ***G21F 5/12*** | (2006.01) |

(52) U.S. Cl.

CPC ..... *G21F 5/10* (2013.01); *G21F 5/008* (2013.01); *G21F 5/12* (2013.01)

(58) Field of Classification Search

CPC ... G21F 5/10; G21F 5/008; G21F 5/12; G21F 5/005; G21F 1/04; G21F 1/08

(Continued)

(56) References Cited

U.S. PATENT DOCUMENTS

2009/0252274 A1* 10/2009 Singh ..... G21F 7/015 376/274
2011/0172484 A1* 7/2011 Singh ..... G21F 5/002 588/16

(Continued)

FOREIGN PATENT DOCUMENTS

CN 109448882 A * 3/2019 ..... G21F 9/36
CN 108461167 B * 8/2021 ..... G21F 5/008

*Primary Examiner* — Darlene M Ritchie
(74) *Attorney, Agent, or Firm* — Thomas | Horstemeyer, LLP

(57) ABSTRACT

Embodiments of a thermal divider insert for a dry storage, spent nuclear fuel cask are disclosed. The thermal divider insert enables safe storage of the hazardous nuclear material when one or more air inlets have been fully or partially blocked to an extent that insufficient air flows into the air inlets and through the cask for adequate cooling of the hazardous nuclear material. A concrete overpack contains a metal canister with the hazardous nuclear material. The overpack has an inside surface that is spaced from an outer surface of the canister to create an annular region that permits flow of air between the surfaces for cooling the canister. Air inlets near the bottom of the overpack communicate air from an outside into the annular region. Outlet vents near the top of the overpack communicate air from the annular region to the outside. The thermal divider insert extends through a respective outlet vent and into the annular region and establishes two separate and opposite air flows through the respective vent and the annular region when the overpack air inlets have been blocked.

11 Claims, 5 Drawing Sheets

(58) Field of Classification Search
USPC ..... 376/272, 456
See application file for complete search history.

(56) References Cited

U.S. PATENT DOCUMENTS

| | | | | |
|---|---|---|---|---|
| 2020/0027608 | A1* | 1/2020 | Singh | G21F 5/008 |
| 2021/0057118 | A1* | 2/2021 | Singh | G21F 5/012 |
| 2021/0057120 | A1* | 2/2021 | Singh | G21F 5/02 |
| 2021/0210238 | A1* | 7/2021 | Singh | G21F 9/36 |
| 2021/0225537 | A1* | 7/2021 | Singh | G21F 3/00 |

* cited by examiner

THERMAL DIVIDER INSERT AND METHOD FOR SPENT NUCLEAR FUEL CASK CREATING BOTH AIR INLETS AND AIR OUTLETS AT THE TOP OF THE OVERPACK

FIELD OF THE INVENTION

The embodiments of the present disclosure generally relate to storage of hazardous radioactive materials and, more particularly, to dry storage, spent nuclear fuel casks for containing spent nuclear fuel or other hazardous radioactive material(s).

BACKGROUND OF THE INVENTION

Spent nuclear fuel has historically been stored in deep reservoirs of water, called "spent fuel pools," within nuclear power plants. This spent fuel storage technology is often termed "wet storage." Spent fuel pools at reactors are reaching their spent fuel capacity limits, causing concerns about the need to shut down reactors because there is no more room for the spent fuel. Dry nuclear spent fuel storage technology (termed "dry storage") is deployed throughout the world to expand the capabilities of nuclear power plants to discharge and store nuclear spent fuel external to a reactor's spent fuel pool, thereby extending the operating lives of the power plants.

There are two fundamental classes of technology used in dry spent fuel storage: (a) metal casks with final closure lids that are bolted closed at the power plants after loading with spent fuel, and (b) concrete storage casks containing metal canisters having canister final closure lids that are welded closed or sealed with mechanical methods at the power plants following spent fuel loading. This latter dry storage technology is referred to as "canister-based concrete spent fuel storage." The concrete cask serves as an enclosure, or "overpack" that provides mechanical protection, heat removal features, and radiation shielding for the inner metal canister that encloses the radioactive materials. The use of this technology tends to have significant capital cost and other economic advantages over the use of metal cask technology for storage.

SUMMARY OF THE INVENTION

Embodiments of a thermal divider insert and method for a dry storage, spent nuclear fuel cask are disclosed. The thermal divider insert enables safe storage of the hazardous nuclear material when one or more air inlets have been fully or partially blocked to an extent that insufficient air flows into the air inlets and through the cask for adequate cooling of the hazardous nuclear material.

In one embodiment, among others, a cask comprises a metal canister having a top, bottom, and sidewall. The canister contains the hazardous nuclear material. A concrete overpack contains the metal canister with the hazardous nuclear material. The overpack has a top, bottom, and sidewall. The overpack has an inside surface that is spaced from an outer surface of the canister to create an annular region that permits flow of air between the surfaces for cooling the canister. One or more air inlets near the bottom of the overpack communicates air from an outside environment into the annular region. One or more outlet vents near the top of the overpack communicates air from the annular region to the outside environment. The thermal divider insert extends through a respective outlet vent and into the annular region and is designed to establish two separate and opposite air flows (i.e., inward air flow and outward air flow) through the respective vent and the annular region when the overpack air inlets have been blocked. When not blocked in normal operation, the two air flows both flow upwardly through the annular region and outwardly from the vent.

An embodiment of the thermal divider insert, among others, comprises (a) a planar horizontal radial plate and (b) a curved vertical plate extending from the radial plate, in order to establish the two separate and opposite air flows through the vent. The horizontal radial plate extends through the overpack outlet vent. The radial plate has a curvature along its inside and outside edges that corresponds to a curvature associated with the overpack outlet vent. The redial plate establishes a lower air flow region and an upper air flow region within the overpack outlet vent. When the one or more air inlets are blocked, then the lower air flow region enables inward air flow from the outside environment, and the upper air flow region enables outward air flow to the outside environment. When the one or more air inlets are not blocked, then the upper and lower air flow regions enable outward air flow to the outside environment.

As for the curved vertical plate, it extends downwardly at a right angle from the inside edge of the radial plate and has a curvature that corresponds to a curvature associated with the annular region. The curved vertical plate essentially establishes an outer annular region and an inner annular region. When the one or more inlets are blocked, the outer annular region enables inward air flow from the lower air flow region within the vent, and the inner annual region enables outward air flow to the upper air flow region of the vent. When the one or more air inlets are not blocked, the outer and inner annular regions enable upward air flow into the lower and upper air flow regions, respectfully, and then outwardly from the vent into the outside environment.

An embodiment of a method, among others, for safely storing hazardous nuclear material when one or more air inlets have been fully or partially blocked to an extent that insufficient air flows into the air inlets and through the cask for adequate cooling of the hazardous nuclear material, comprises the steps of: when the one or more air inlets are not blocked, enabling air flow into the air inlets, through the annular region, and then through and out of the one or more air vents; and when the air inlets are blocked, enabling air flow inwardly through the vents, then through the annular region, and then through and out of the vents. Furthermore, another embodiment is an apparatus having a means for performing each of the foregoing steps.

Other embodiments, apparatus, methods, features, and advantages of the present invention will be apparent to one with skill in the art upon examination of the following drawings and detailed description. It is intended that all such additional embodiments, apparatus, methods, features, and advantages be included within this disclosure, be within the scope of the present invention, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENT

Figure 1:
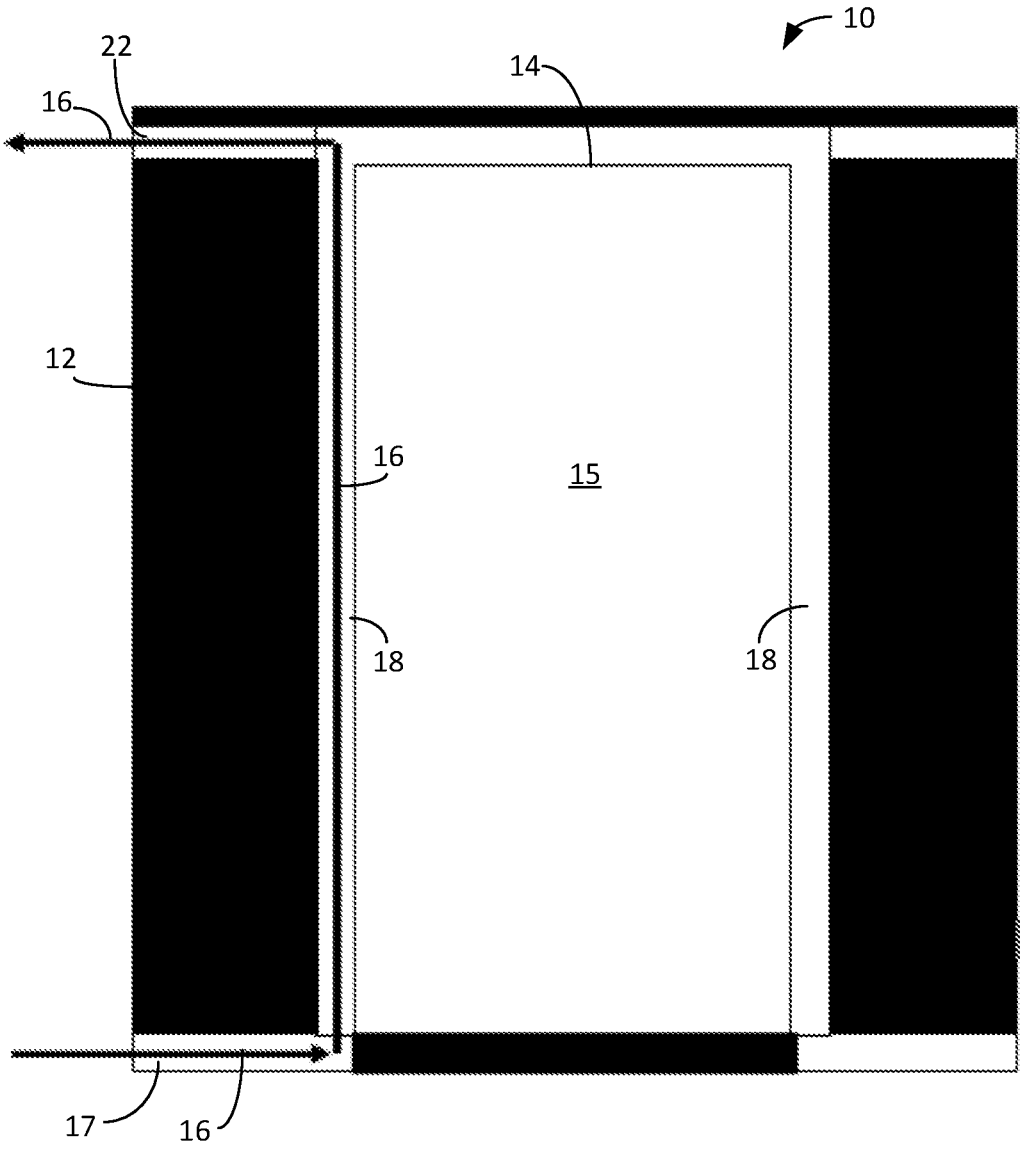
FIG. 1 (PRIOR ART)
FIG. 1 is a cross-sectional view of a typical, prior art dry storage, spent nuclear fuel cask having an overpack with canister containing radioactive material(s) stored therein with the typical air movement through the annular region between the overpack and the canister.

FIG. 1 shows a cross-sectional view of a typical, prior art, dry storage, spent nuclear fuel cask 10 having an overpack 12 with canister 14 containing a radioactive material(s) 15 stored therein with the typical air 16 into one or more air inlets 17, through an annular region 18 between the overpack 12 and the canister 14, and then out of one or more air outlet vents 22. The canister 14 in the preferred embodiment is primarily (or substantially) metal, such as stainless steel, and generally cylindrical in shape with a flat top, a flat bottom, and cylindrical sidewall. The overpack 12 in the preferred embodiment is primarily (or substantially) concrete and generally cylindrical in shape with a flat top, a flat bottom, and cylindrical sidewall.

The overpack heat removal function associated with canister-based spent fuel storage relies upon natural circulation of air though the annular region 18 between the overpack vertical inner boundary and the vertical outer boundary of the metal canister 14 containing the radioactive material stored within the overpack 12. The cooler, more dense air 16 is introduced into the annular region 18 via the one of more inlets 17 where the air 16 absorbs heat which is being emitted from the radioactive material 15 in the canister 14, thereby becoming less dense and more buoyant. This increased buoyancy results in the less dense air 16 rising upward through the annular region 18 until the air 16 reaches the upper area where is exits the overpack 12 via the one or more outlet vents 22. The movement of air 16 through the annular region 18, as described, is a continuous process that results in the removal of heat from the radioactive material 15 stored within the canister 14, thereby ensuring that the temperature of the radioactive material 15 is maintained below a predetermined limit.

Figure 2:
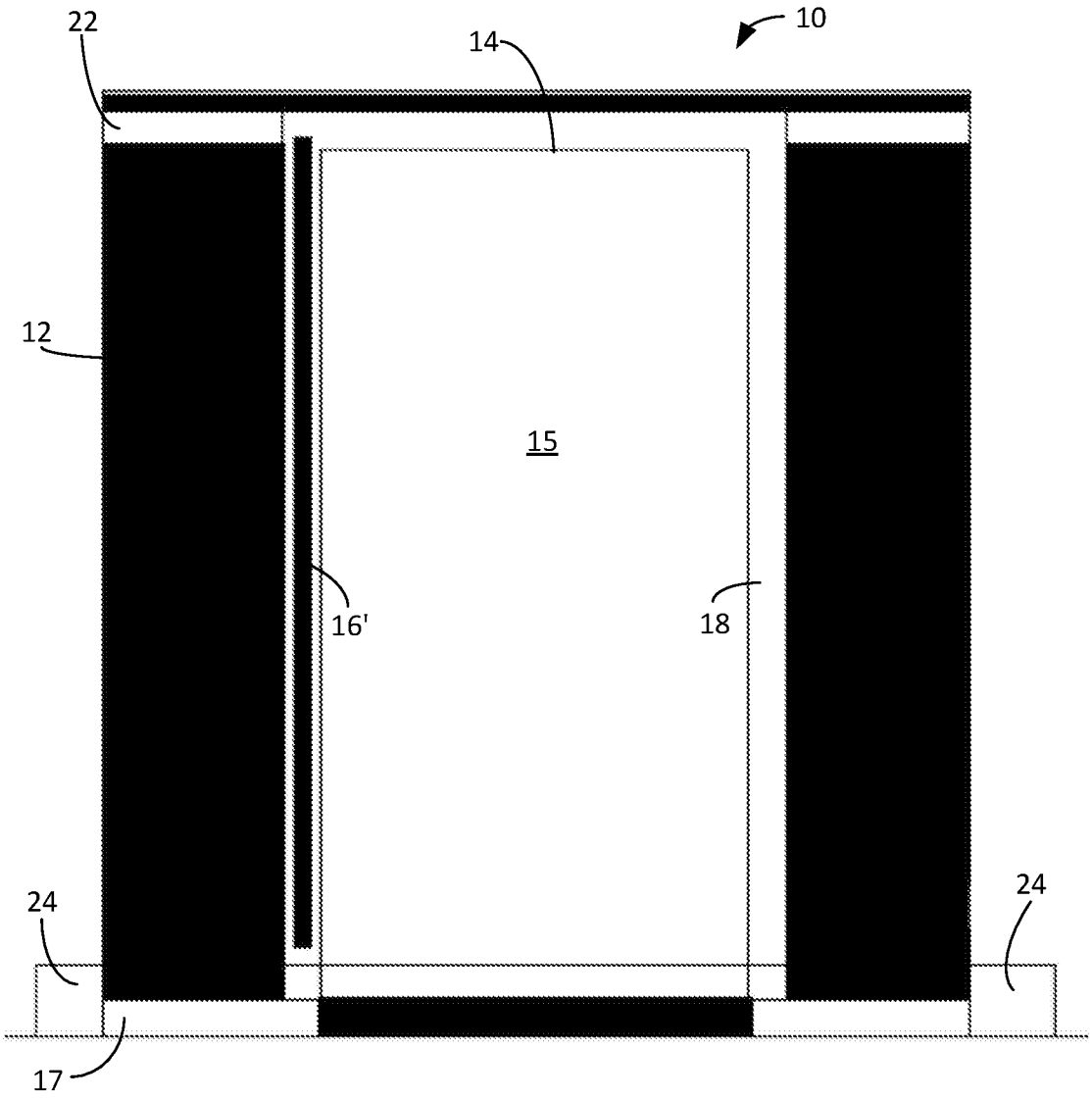
FIG. 2 (PRIOR ART)
FIG. 2 is a cross-sectional view of the cask of FIG. 1 with stagnant air due to substantial blockage of one or more overpack air inlets.

With reference to FIG. 2, in the unlikely event that water flooding of the area where the cask 10 is stored, it is conceivable that the flood water 24 could cover the one or more overpack air inlets 17, in whole or in part, thereby interrupting the introduction of air 16 (FIG. 1) into the annular region 18. Generally, FIG. 2 shows a cross-sectional view of the cask 10 with stagnant air 16' due to substantial blockage of the overpack inlets 17 by the flood water 24. This interruption of the flow of air 16 could result in an undesirable and dangerous increase in temperature of the radioactive material 15, potentially above desirable and/or allowable levels.

The annular region 18 within the overpack 12 serves to act as a single column for air 16 to travel upward through as the air 16 absorbs heat, becoming less dense. With the blockage of the normal introduction path for cooler, less dense air 16 at the bottom of the overpack 12, this single column for air 16 becomes stagnated, thereby resulting in no means to create a thermally induced driving force based on different air densities.

Figure 3:
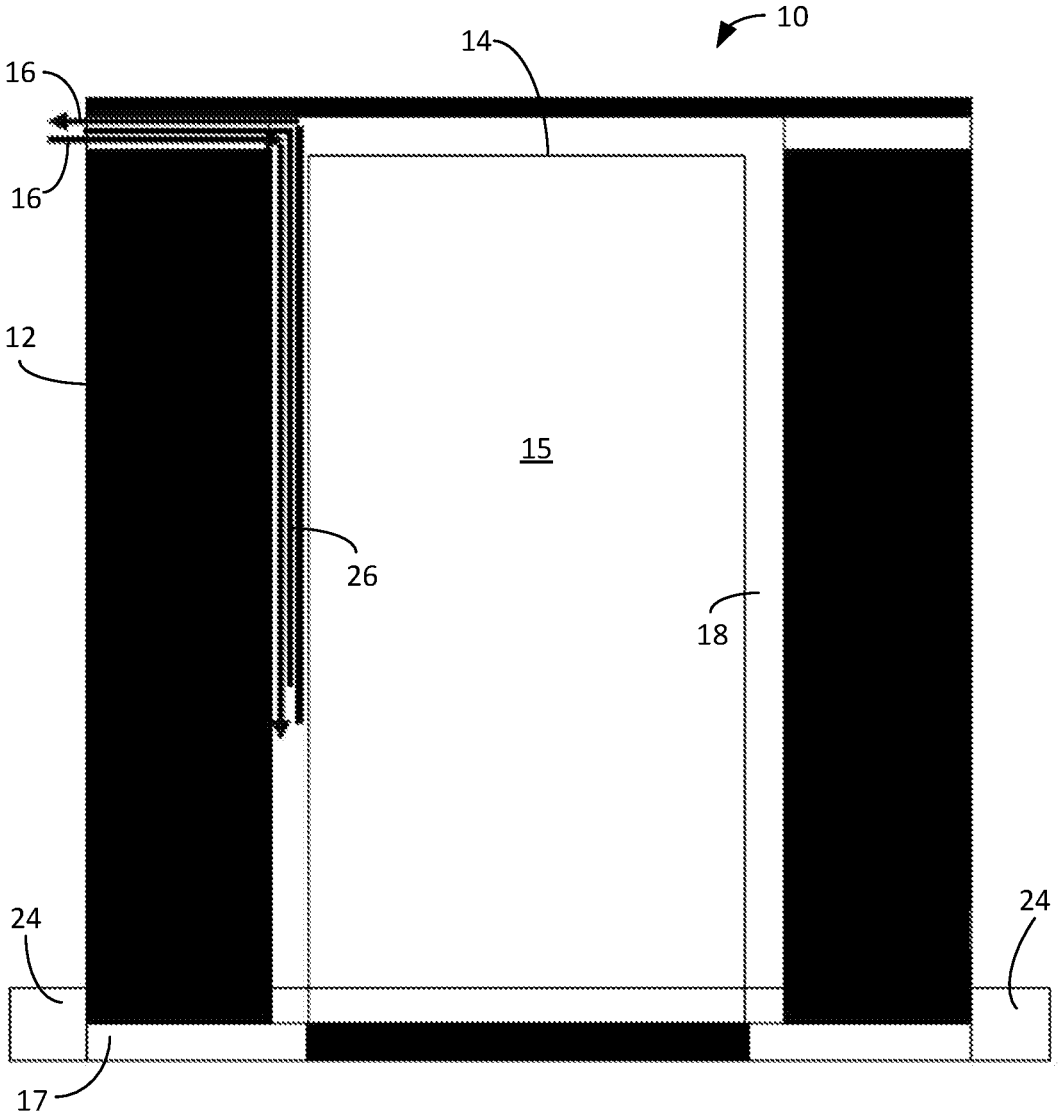
FIG. 3 shows a cask having an overpack with canister containing radioactive material stored therein with an overpack having an inner annular air flow established by the thermal divider insert of the present invention, which establishes a separated air flow, thereby cooling the canister and radioactive contents despite substantial blockage of the overpack inlets.
Figure 4:
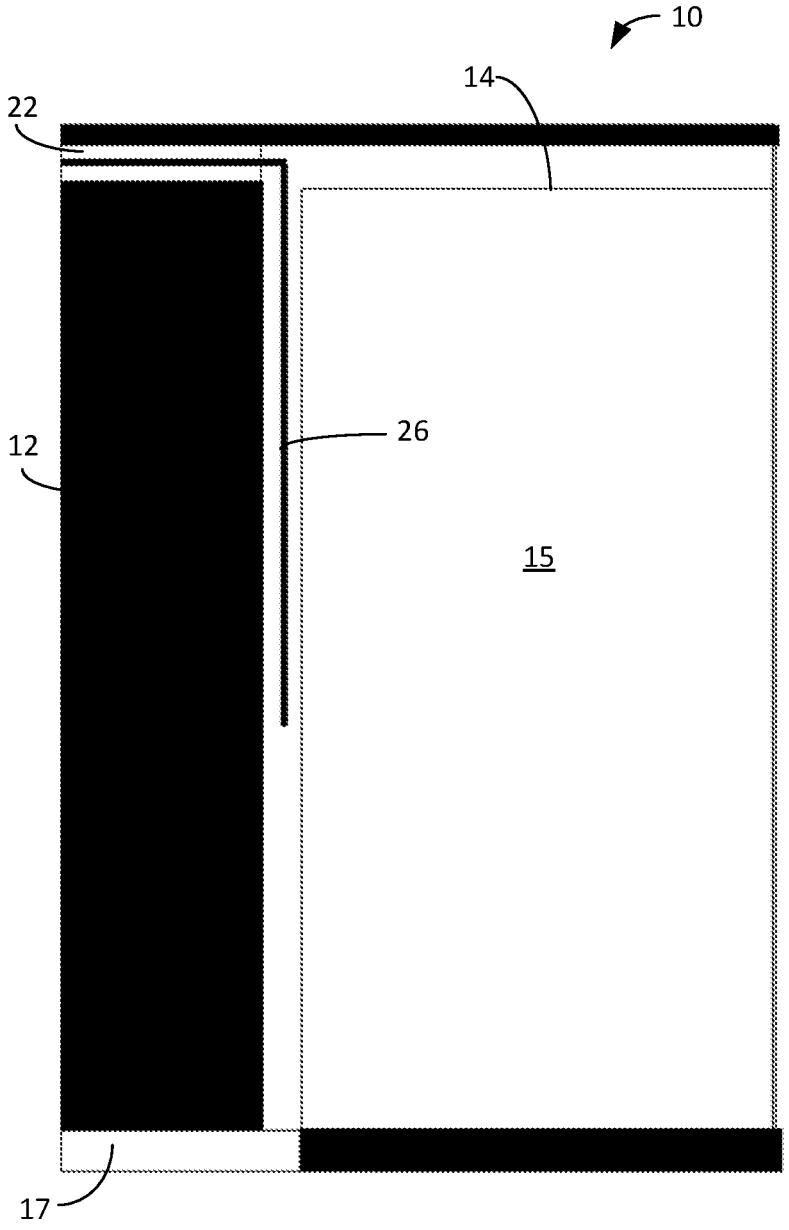
FIG. 4 a partial enlarged cross-sectional view of the cask with thermal divider insert of FIG. 3.
Figure 5:
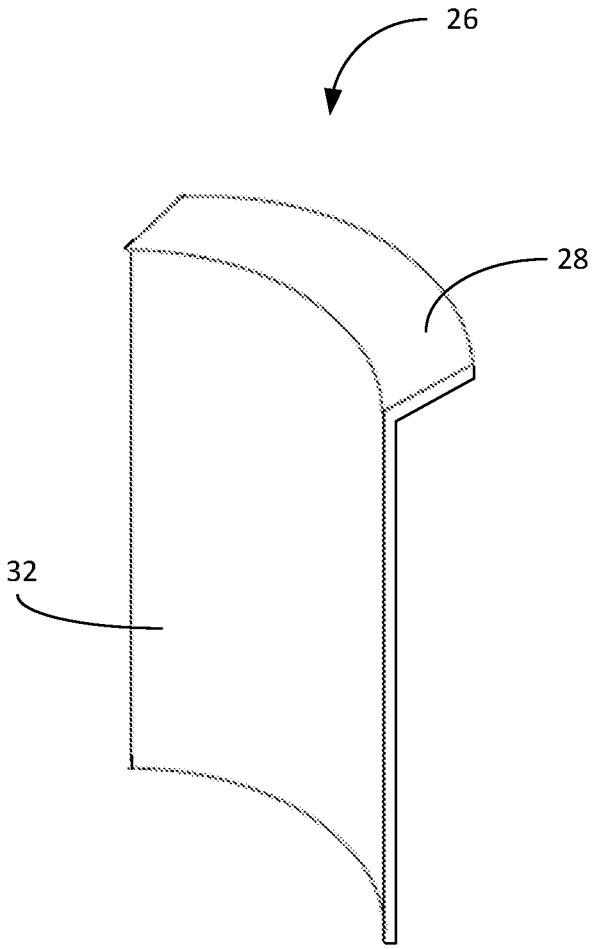
FIG. 5 is a perspective view of the uninstalled thermal divider insert of FIGS. 3 and 4.

As illustrated in FIGS. 3 through 5, the present disclosure provides a thermal divider insert 26 that is devised specifically to address this stagnant air condition when the air inlets 17 are blocked. One of more of the thermal divider inserts 26 are installed in the overpack 12. Each thermal divider insert 26 extends through a respective air outlet vent 22 and into the annular region 18.

As shown in FIG. 5, each thermal divider insert 26 is an angular plate configured in such a manner so as to have a complex right-angle appearance that is concurrently radially shaped to conform to the inner radial dimension of the overpack 12 along both vertical and horizontal surfaces. The thermal divider insert 26 can be made from any suitable materials, but in the preferred embodiment, is primarily metal, such as stainless steel. The thermal divider insert 26 can be any suitable thickness. The material and thickness should give sufficient rigidity to the structure. Furthermore, the thermal divider insert 26 is mounted via bolts, welding, or some other suitable known method.

With reference to FIG. 3, the thermal divider insert 26 is installed in the overpack 12 and is configured in such a manner that the horizontal portion 28 of the insert 26 effectively divides the overpack outlet vent 22 into two distinct areas: a lower area and an upper area. The vertical plate 32 of the thermal divider insert 26 is aligned in the overpack annular region 18 between the inner boundary wall of the overpack 12 and the outer wall of the canister 14 containing radioactive material 15 stored within the overpack 12, thereby dividing the annular region 18 into two distinct areas: an inner annular region and an outer annular region. The curved vertical plate 32 extends a substantial vertical distance downwardly through the annular region 18, preferably at least half the vertical span of the annular region 18. In the preferred embodiment, the vertical plate 32 extends about sixty percent of the vertical distance of the annular region.

The thermal divider insert 26 acts as a thermal material shield during normal system operation (i.e., no flood condition present that blocks the overpack inlets 17). When the one or more air inlets are not blocked, then the outer and inner annular regions enable upward air flow into the lower and upper air flow regions, respectfully, of the vents 22, and then outward air flow from the vents 22 into the outside environment.

Upon blockage of the overpack inlets 17 due to flood waters (or any other postulate condition that prevents or otherwise inhibits the introduction of cooler, more dense air 16 into the overpack inlets 17), a thermal imbalance is initially encountered within the annular region 18, resulting initially in a stagnant air condition. Since the radioactive material 15 within the canister 14 will continue to emit heat, the air 16 closest to the canister 14 will continue to absorb heat, thereby creating a difference in density as compared to the air 16 closest to the inner surface of the overpack 12. As shown by the arrows in FIG. 3, due to the presence of the thermal divider insert 26, a separation of the different density air masses will be established such that the air 16 closest to the canister 14 will begin to rise due to buoyancy and will exit the overpack 12 via the upper region of the overpack outlet vent 22. Conversely, relatively cooler, more dense air will enter into the overpack 12 via the lower region of the overpack outlet vent 22, travelling downward into the outer annular region of the annular region 18, then turning inward and travelling upward within the inner annular region of the annular region 18 that has been established by the thermal divider insert 26, thereby re-establishing air flow through the annular region 18 and removing heat being emitted from the radioactive material 15 stored within the canister 14.

Finally, it should be emphasized that the above-described embodiments of the present invention, particularly, any "preferred" embodiments, are merely possible nonlimiting examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

As an example, it is envisioned that other embodiments of the thermal divider insert 26 of FIG. 5 can designed with a different configuration, shape, size, etc., as compared to the preferred embodiment to achieve the desired goal of establishing two separate and opposite air flows (inward air flow and outward air flow) through the respective vent and the annular region when the overpack air inlets 17 have been blocked.

The invention claimed is:

1. A dry storage cask for safely storing hazardous nuclear material when one or more air inlets have been fully or partially blocked to an extent that insufficient air flows into the air inlets and through the cask for adequate cooling of the hazardous nuclear material, the cask comprising:

a cylindrical metal canister having a top, bottom, and sidewall, the canister containing hazardous nuclear material;

a cylindrical concrete overpack containing the metal canister with the hazardous nuclear material, the overpack having a top, bottom, and sidewall, the overpack having an inside surface that is spaced from an outer surface of the canister to create an annular region that permits flow of air between the surfaces;

an overpack air inlet near the bottom of the overpack that can communicate air from an outside environment into the annular region;

an overpack outlet vent near the top of the overpack that can communicate air from the annular region to the outside environment; and a thermal divider insert extending through the outlet vent and through the annular region, the thermal divider insert configured to: (a) permit two separate air flows upwardly through the annular region and outwardly through the respective vent; and (b) permit two separate and opposite air flows through the respective vent and the annular region, the two air flows including an inward air flow into the vent and then into the annular region and an outward air flow out of the annular region and then out of the vent;

wherein the thermal divider insert comprises:

a planar horizontal radial plate extending through the overpack outlet vent, the radial plate having a curvature along its inside and outside edges that corresponds to a curvature associated with the overpack outlet vent, the plate establishing a lower air flow region and an upper air flow region within the overpack outlet vent, the lower air flow region for inward air flow from the outside environment, the upper air flow region for outward air flow to the outside environment; and a curved vertical plate extending downwardly at a right angle from the inside edge of the radial plate, the curved vertical plate having a curvature that corresponds to a curvature associated with the annular region, the curved vertical plate establishing an outer annular region and an inner annular region, the outer annular region enabling the inward air flow from the lower air flow region within the vent, the inner annual region enabling the outward air flow to the upper air flow region of the vent.

2. The cask of claim 1, wherein the curved vertical plate extends a substantial vertical distance through the annular region, the substantial distance being at least half of the vertical length of the annular region.

3. The cask of claim 1, wherein a first air flow is vertically below a second air flow in the outlet vent.

4. The cask of claim 1, wherein the thermal divider insert is substantially made of metal.

5. A cask for safely storing hazardous nuclear material when one or more air inlets have been fully or partially blocked to an extent that insufficient air flows into the air inlets and through the cask for adequate cooling of the hazardous nuclear material, the cask comprising:

a cylindrical metal canister having a top, bottom, and sidewall, the canister containing hazardous nuclear material;

a cylindrical concrete overpack containing the metal canister with the hazardous nuclear material, the overpack having a top, bottom, and sidewall, the overpack having an inside surface that is spaced from an outer surface of the canister to create an annular region that permits flow of air between the surfaces;

an overpack air inlet near the bottom of the overpack that can communicate air from an outside environment into the annular region;

an overpack outlet vent near the top of the overpack that can communicate air from the annular region to the outside environment; and a thermal divider insert, the thermal divider insert comprising:

a planar horizontal radial plate extending through the overpack outlet vent, the radial plate having a curvature along its inside and outside edges that corresponds to a curvature associated with the overpack outlet vent, the plate establishing a lower air flow region and an upper air flow region within the overpack outlet vent, the lower and upper air flow regions for outward air flow to the outside environment when the air inlet is not blocked, the lower air flow region for inward air flow from the outside environment and the upper air flow region for outward air flow to the outside environment when the air inlet is blocked; and a curved vertical plate extending downwardly at a right angle from the inside edge of the radial plate, the curved vertical plate having a curvature that corresponds to a curvature associated with the annular region, the curved vertical plate establishing an outer annular region and an inner annular region, the outer and inner annular regions enabling upward air flow into the lower and upper air flow regions respectively within the vent when the air inlet is not blocked, the inner annual region enabling upward air flow to the upper air flow region of the vent and the outer annular region enabling inward air flow from the lower air flow region within the vent when the air inlet is blocked.

6. The cask of claim 5, wherein the thermal divider insert is substantially made of metal.

7. The cask of claim 5, wherein the curved vertical plate extends a substantial vertical distance through the annular region, the substantial distance being at least half of the vertical length of the annular region.

8. A cask for storing hazardous nuclear material, comprising:

a canister having a top, bottom, and sidewall, the canister containing hazardous nuclear material;

a concrete overpack comprising:

the canister with the hazardous nuclear material, the overpack having a top, bottom, and sidewall, the overpack having an inside surface that is spaced from an outer surface of the canister to create an annular region that permits flow of air between the surfaces;

an overpack air inlet near the bottom of the overpack that can communicate air from an outside environment into the annular region;

an overpack outlet vent near the top of the overpack that can communicate air from the annular region to the outside environment; and a thermal divider means for establishing: (a) when the air inlet is unblocked, two separate air flows upwardly through the annular region and outwardly from the respective vent; and (b) when the air inlet is blocked, two separate and opposite air flows through the respective vent and the annular region, the two air flows including an inward air flow into the vent and then into the annular region and an outward air flow out of the annular region and then out of the vent;

wherein the thermal divider means comprises in structure:

a planar horizontal radial plate extending through the overpack outlet vent, the radial plate having a curvature along its inside and outside edges that corresponds to a curvature associated with the overpack outlet vent, the plate establishing a lower air flow region and an upper air flow region within the overpack outlet vent, the lower and upper air flow regions for outward air flow to the outside environment when the air inlet is not blocked, the lower air flow region for inward air flow from the outside environment and the upper air flow region for outward air flow to the outside environment when the air inlet is blocked; and a curved vertical plate extending downwardly at a right angle from the inside edge of the radial plate, the curved vertical plate having a curvature that corresponds to a curvature associated with the annular region, the curved vertical plate establishing an outer annular region and an inner annular region, the outer and inner annular regions enabling upward air flow into the lower and upper air flow regions respectively within the vent when the air inlet is not blocked, the inner annual region enabling upward air flow to the upper air flow region of the vent and the outer annular region enabling inward air flow from the lower air flow region within the vent when the air inlet is blocked.

9. The cask of claim 8, wherein the canister and thermal divider means are substantially made of metal and wherein the overpack is substantially made of concrete.

10. The cask of claim 8, wherein the sidewall associated with the canister and the overpack is generally cylindrical in shape.

11. The cask of claim 8, wherein the cask comprises a plurality of air inlets, a plurality of air vents, and a plurality of thermal divider means corresponding respectively to the plurality of air vents.

* * * * *